US006474217B1

(12) United States Patent
Kaneko

(10) Patent No.: US 6,474,217 B1
(45) **Date of Patent: *Nov. 5, 2002**

(54) RODLESS CYLINDER

(75) Inventor: Junya Kaneko, Abiko (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,742

(22) Filed: Oct. 18, 2000

(30) Foreign Application Priority Data

Oct. 18, 1999 (JP) ..... 11-295390

(51) Int. Cl.[7] ..... F01B 29/00
(52) U.S. Cl. ..... 92/88; 92/177
(58) Field of Search ..... 92/88, 265 PR, 92/177

(56) References Cited

U.S. PATENT DOCUMENTS 651,864 A * 6/1900 Kelly ..... 92/88
3,180,236 A * 4/1965 Beckett ..... 92/177
3,557,663 A * 1/1971 Florjancic ..... 91/394
5,245,912 A 9/1993 Muller et al. ..... 92/137
5,305,682 A * 4/1994 Kaneko ..... 92/88
5,568,982 A * 10/1996 Stoll et al. ..... 92/88
6,092,456 A * 7/2000 Noda et al. ..... 92/88

FOREIGN PATENT DOCUMENTS

| | | |
|---|---|---|
| DE | 24 31 706 | 1/1976 |
| DE | 40 41 370 | 7/1992 |
| DE | 195 31 523 | 4/1996 |

* cited by examiner

*Primary Examiner*—F. Daniel Lopez
(74) *Attorney, Agent, or Firm*—Paul A. Guss

(57) ABSTRACT

In a cylinder tube of a rodless cylinder, a bore having an approximately rhombic cross section is formed. The approximately rhombic cross section of the bore has a thickness smaller than a width. There is a fluid bypass passage for centralized piping in the vicinity of the bottom of both sides of the bore in the cylinder tube. In addition, in the vicinity of both sides of the bore at the upper and lower surfaces of the cylinder tube, there are thinned portions.

9 Claims, 7 Drawing Sheets

RODLESS CYLINDER

BACKGROUND OF THE INVENTION

1. Field of the Invention

The present invention relates to rodless cylinders and more specifically to a rodless cylinder characterized by the shape of its bore.

2. Description of the Related Art

A rodless cylinder is conventionally employed as a transfer device for a workpiece in a factory or the like. The rodless cylinder has a shorter length than a cylinder having a rod, considering a displacement length. Therefore, the rodless cylinder occupies a smaller area, is easy to handle and allows a high level positioning operation or the like.

The rodless cylinder mainly includes a cylinder tube having a bore, a piston provided in the bore, and a slide table coupled to the piston to reciprocate along the cylinder tube with the movement of the piston. In this case, the bore is formed to have an approximately circular cross section.

Meanwhile, there has been a demand for reducing the thickness of the rodless cylinders. However, the space for forming the bore must be secured in the cylinder tube, which makes it difficult to reduce the thickness of the rodless cylinder having the bore with an approximately circular cross section.

Thus, rodless cylinders having a bore with an approximately oval or ellipse cross section have been developed and reduced to practice in order to provide rodless cylinders with a reduced thickness.

However, in such a cylinder tube having a bore with an approximately oval or ellipse cross section, the rigidity thereof is likely to be reduced if a thickness of the cylinder tube or an ellipticity relating to a cross sectional shape of the bore would not be suitable. Further, in the cylinder tube having a bore with an approximately oval or ellipse cross section, it is difficult to provide centralized piping through the cylinder tube when thinned portions are formed on the cylinder tube.

SUMMARY OF THE INVENTION

It is a general object of the invention to provide a rodless cylinder having a reduced thickness while maintaining high rigidity.

It is a main object of the invention to provide a rodless cylinder with a reduced thickness while securing a space to form a fluid bypass passage.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
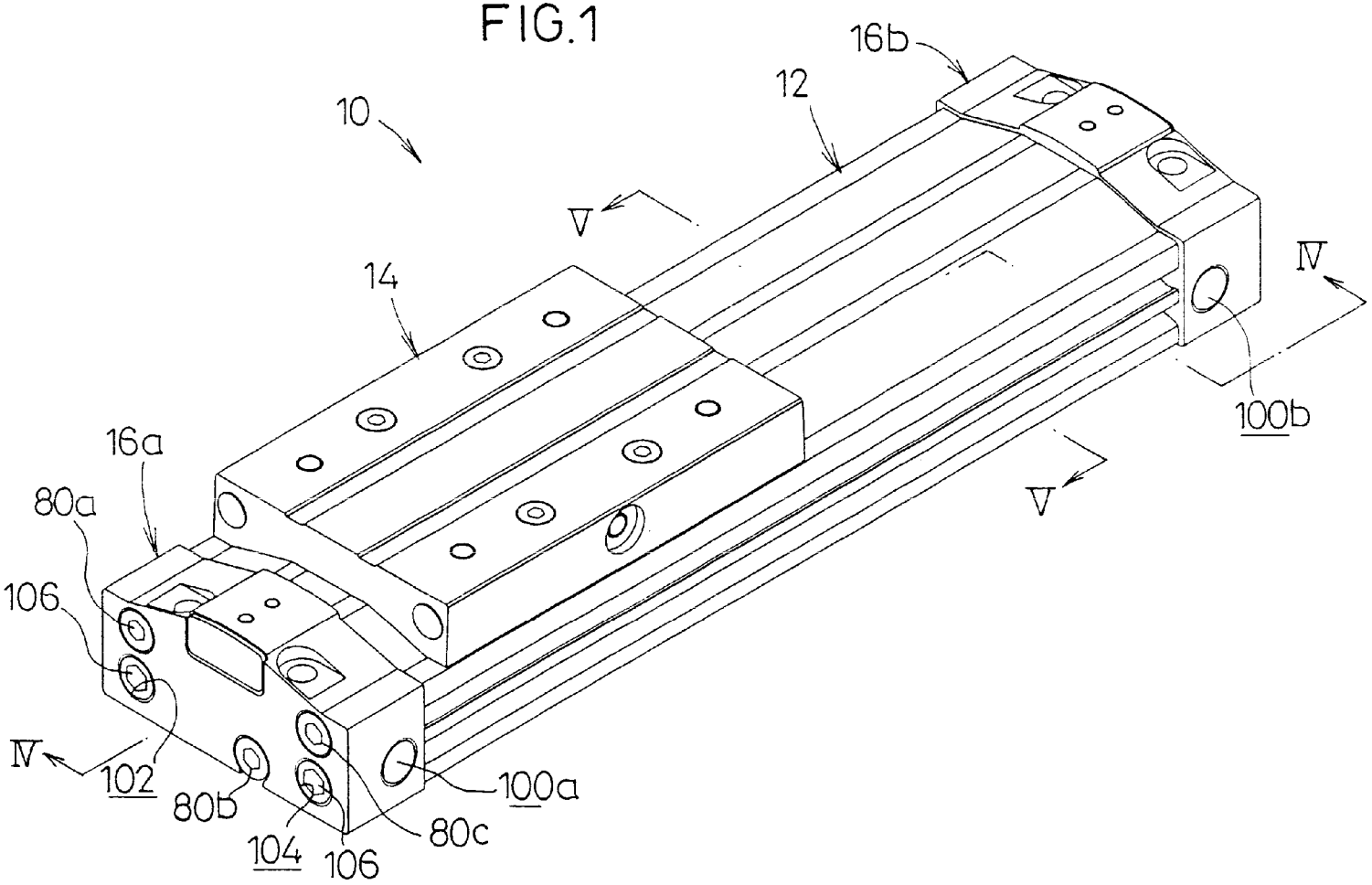
FIG. 1 is a perspective view of the general structure of a rodless cylinder according to an embodiment of the present invention.

As shown in FIG. 1 a rodless cylinder 10 according to an embodiment of the present invention includes a cylinder tube 12, a slide table 14 attached to the cylinder tube 12 and capable of reciprocating in the longitudinal direction, and end plates 16*a*, 16*b* attached at both ends of the cylinder tube 12.

Figure 2:
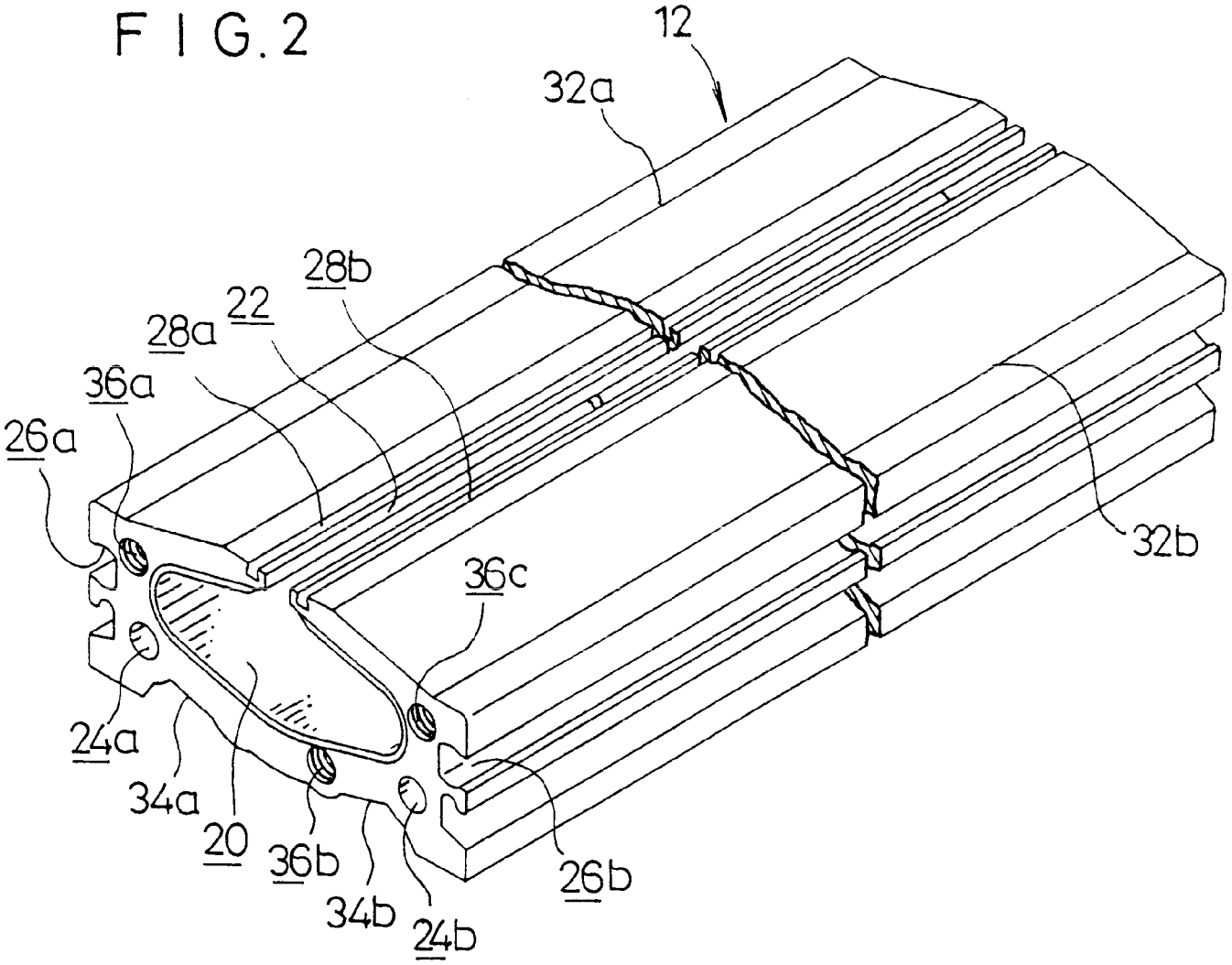
FIG. 2 is a perspective view of a cylinder tube which is a main part of the rodless cylinder shown in FIG. 1.
Figure 3:
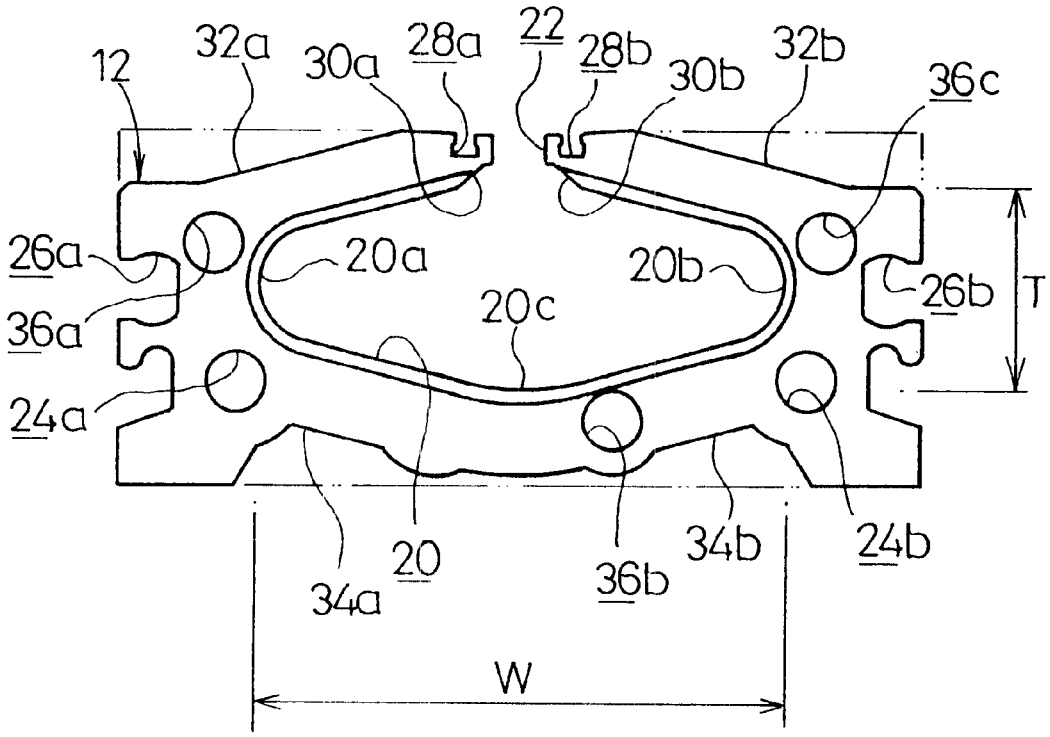
FIG. 3 is a side view of the cylinder tube shown in FIG. 2 viewed from an end side.

As shown in FIGS. 2 and 3, there is a bore 20 extending in the longitudinal direction in the cylinder tube 12. There is a slit 22 formed in the longitudinal direction at the upper surface of the cylinder tube 12, and the bore 20 is in communication with the outside through the slit 22. In the cylinder tube 12, in the vicinity of the bottom at both sides of the bore 20, fluid bypass passages 24*a*, 24*b* for centralized piping are formed along the bore 20.

At both side surfaces of the cylinder tube 12, elongate grooves 26*a*, 26*b* for attaching a sensor are formed in the longitudinal direction. The elongate grooves 26*a*, 26*b* for attaching a sensor are provided with a sensor or the like (not shown) used to detect the position of a piston 50 which will be described. The elongate grooves 26*a*, 26*b* for attaching a sensor may also be used as grooves for attaching a stopper member 90 which will be described (see FIG. 7).

At the upper surface of the cylinder tube 12, provided on both sides of the slit 22 in the longitudinal direction of the cylinder tube 12 are belt mounting grooves 28*a*, 28*b* for mounting an upper belt 64 which will be described.

As shown in FIG. 3, the bore 20 is formed to have an approximately rhombic cross section. More specifically, the thickness (height) of the bore 20 on both sides is smaller than that of the central part. The rhombic cross section of the bore 20 has a thickness T smaller than a width W.

In this case, the values of the thickness T and the width W are preferably set so that the ratio of the thickness relative to the width approximately perpendicular to the axial line in the cylinder tube 12 is about 50% or less.

Furthermore, the corner portions 20*a* to 20*c* of the rhombic cross section of the bore 20 are each formed to be approximately circular. In this case, the radius of curvature of the corner portion 20*c* is set to be larger than those of the other corner portions 20*a* and 20*b*. Taper portions 30*a*, 30*b* are formed at the border of the bore 20 and the slit 22. The distance between the taper portions 30*a*, 30*b* gradually decreases toward the outer side.

At the upper surface of the cylinder tube 12, formed in the vicinity of both sides of the bore 20 are thinned portions 32*a*, 32*b* having a thickness reduced at the corner portion as compared to the rectangle circumscribed around the cylinder tube 12 (in the double dotted chain line in FIG. 3). Similarly, at the lower surface of the cylinder tube 12, formed in the vicinity of both sides of the bore 20 are thinned portions 34*a*, 34*b* having a thickness reduced into a recess as compared to the rectangle circumscribed around the cylinder tube 12.

At both ends of the cylinder tube 12, screw holes 36*a* to 36*c* to attach the end plates 16*a*, 16*b* are formed.

In this case, except for the position where the screw holes 36*a* to 36*c* are formed, the cylinder tube 12 is formed in approximate symmetry.

Note that the cylinder tube 12 is formed for example by extruding a metal material such as aluminum and an aluminum alloy.

Figure 4:
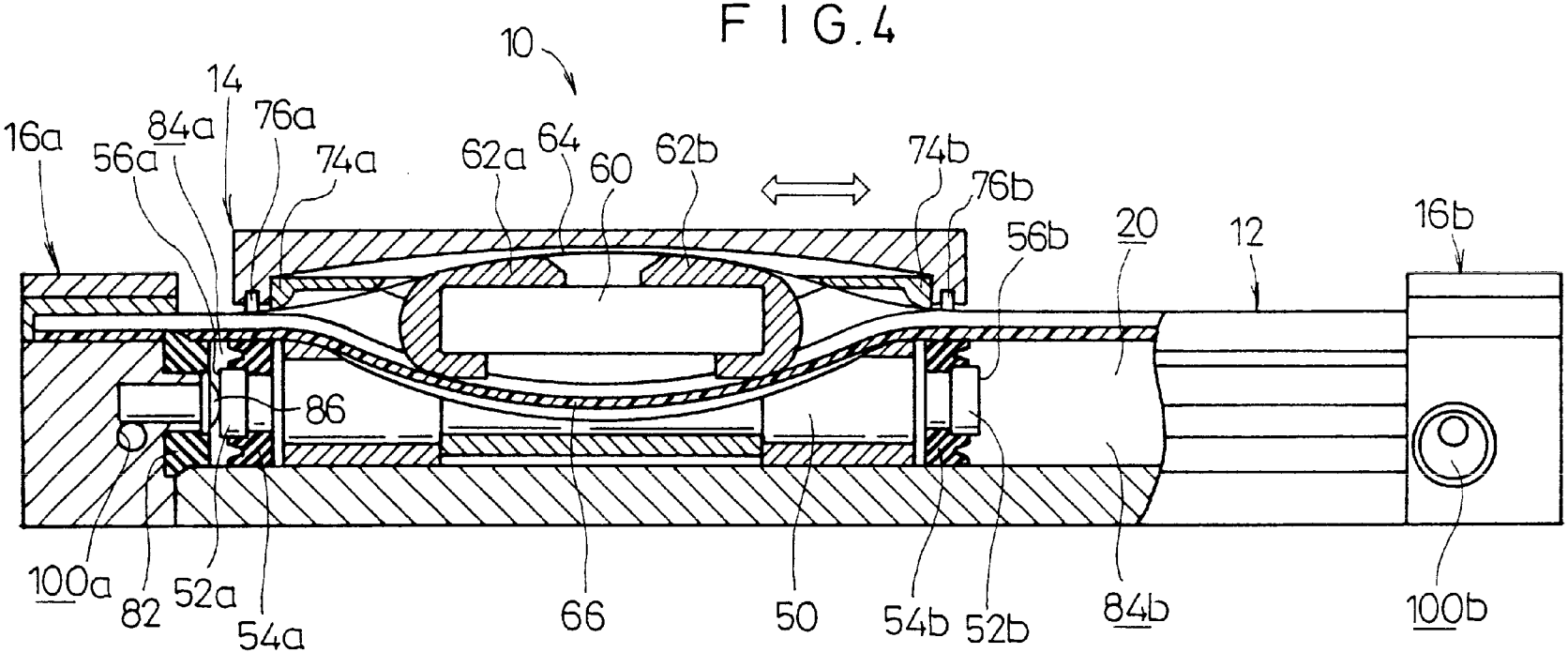
FIG. 4 is a vertical sectional view of the rodless cylinder shown in FIG. 1 taken along line IV—IV.

As shown in FIG. 4, the piston 50 having a cross section corresponding to the bore 20 is inserted in the bore 20 of the cylinder tube 12 and the piston 50 can reciprocate therein.

Figure 5:
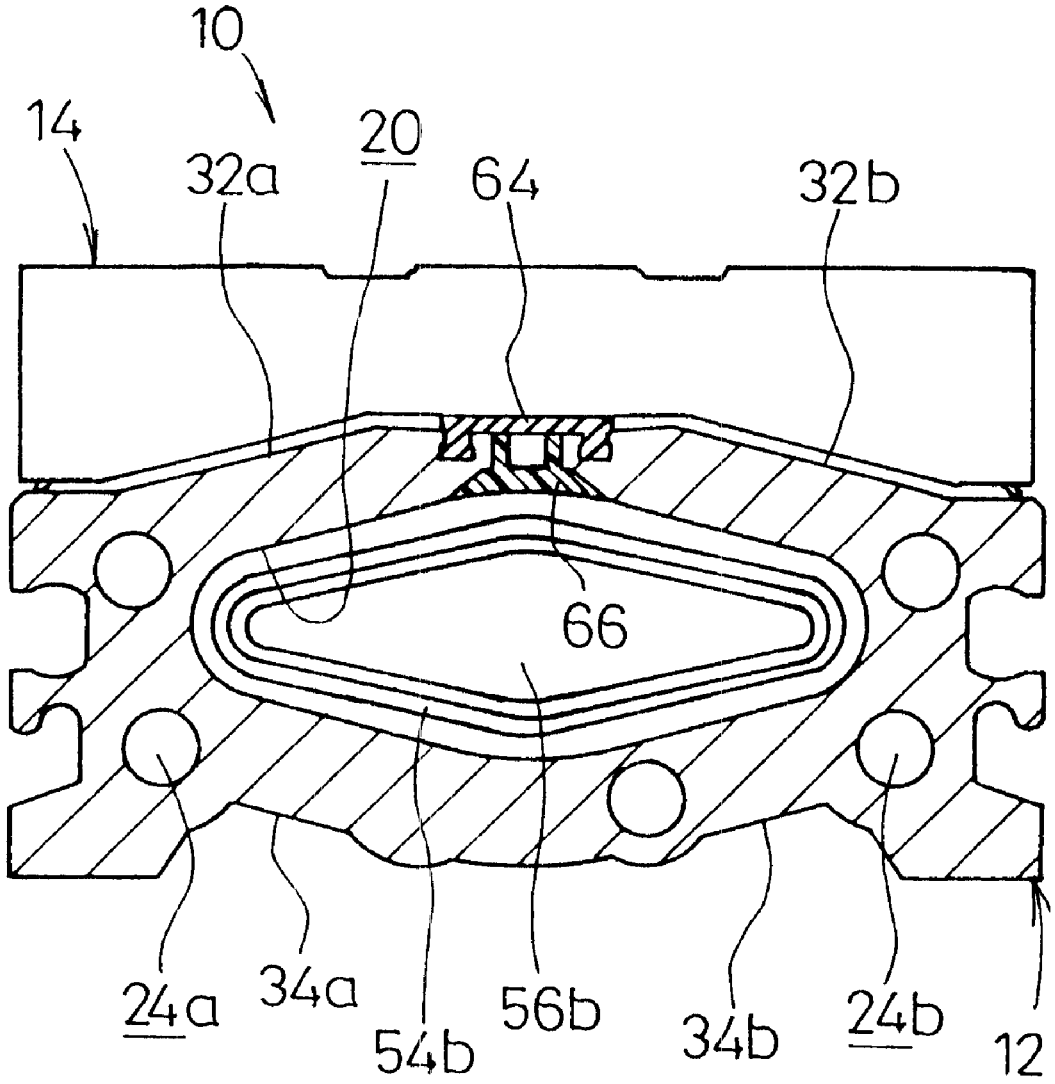
FIG. 5 is a vertical sectional view of the rodless cylinder shown in FIG. 1 taken along line V—V.

As shown in FIGS. 4 and 5, projections 52*a*, 52*b* are formed on both ends in the longitudinal direction of the piston 50. The projections 52*a* and 52*b* are attached with seal members 54*a* and 54*b*, respectively. In this case, the end surfaces of the projections 52*a* and 52*b* serve as pressure receiving surfaces 56*a* and 56*b*, respectively.

As shown in FIG. 5, the outer peripheral shape of the seal members 54*a* and 54*b* corresponds to the cross sectional shape of the bore 20, and is formed into an approximately rhombic shape with circular corners. As a result, the seal members 54*a* and 54*b* seal the space between the piston 50 and the inner wall surface of the bore 20.

As shown in FIG. 4, the piston 50 is provided with a piston yoke 60 projecting to the upper side, and at both ends of the piston yoke 60 on the upper side, a pair of belt separators 62*a*, 62*b* are attached a prescribed distance apart from one another. The piston 50 is coupled with the slide table 14 to cover the piston yoke 60 and the belt separators 62*a* and 62*b*. In this case, the slide table 14 is in contact with the upper surface of the cylinder tube 12 for example through a guide mechanism which is not shown.

As shown in FIGS. 4 and 5, the slit 22 in the cylinder tube 12 is attached with the upper belt 64 and lower belt 66 for sealing to block the slit 22 from the top and the bottom. For example, the upper belt 64 is formed of a rubber material or a resin material, while the lower belt 66 is formed of a resin material.

Figure 6:
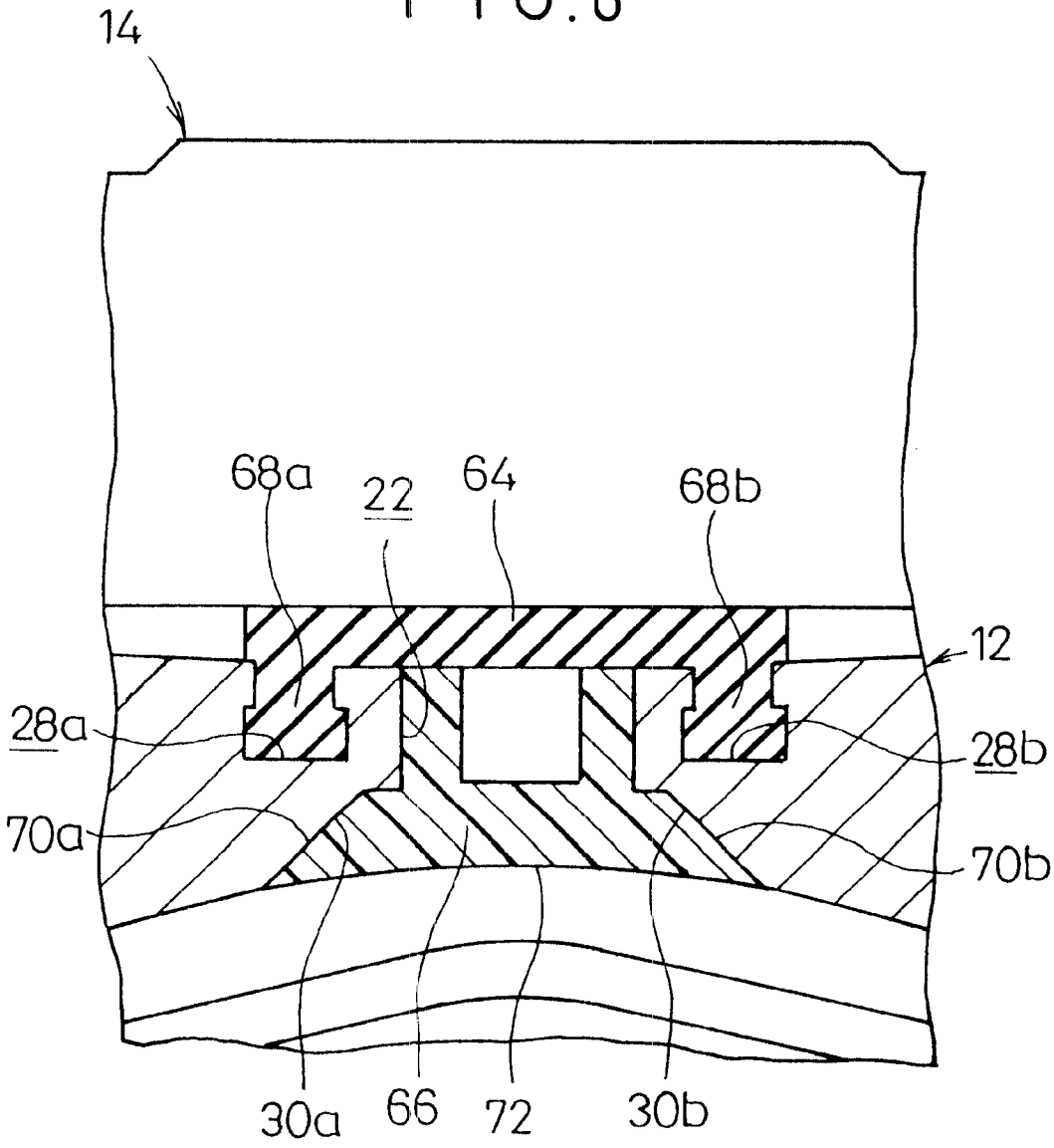
FIG. 6 is a partly enlarged, vertical sectional view showing the vicinity of the slit in the rodless cylinder in FIG. 5.

FIG. 6 is an enlarged view of the vicinity of the slit 22 in FIG. 5. As shown in FIG. 6, the upper belt 64 is provided with leg portions 68*a*, 68*b*. The upper belt 64 is mounted to the cylinder tube 12 by fitting the leg portions 68*a* and 68*b* into the belt mounting grooves 28*a*, 28*b* of the cylinder tube 12, respectively. Further, it is preferable that the upper belt 64 separably comprises a flat plate made of stainless steel and legs made of magnetic material allowing the flat plate to be magnetically attached to the legs.

On both sides at the upper surface of the lower belt 66, taper portions 70*a*, 70*b* formed corresponding to the taper portions 30*a*, 30*b* of the cylinder tube 12 are provided. The lower belt 66 is mounted to the cylinder tube 12 such that the taper portions 70*a*, 70*b* and the taper portions 30*a*, 30*b* are in a close contact state.

The lower surface portion 72 of the lower belt 66 is formed into a circular shape corresponding the circular shape of the upper ends (upper corner portions) of the seal members 54*a*, 54*b*. As a result, the space between the lower belt 66 and seal members 54*a*, 54*b* is sealed.

As shown in FIG. 4, both ends of the upper and lower belts 64 and 66 (only the left end is shown in FIG. 4) are secured to the end plates 16*a*, 16*b*, respectively.

The belt separators 62*a*, 62*b* are held between the upper belt 64 and the lower belt 66 apart from one another in the vertical direction. In this case, the upper belt 64 is passed through the space formed between the belt separators 62*a*, 62*b* and the slide table 14, while the lower belt 66 is passed through the space formed between the belt separators 62*a*, 62*b* and the piston 50.

On both end sides of the slide table 14, there are presser members 74*a*, 74*b*, which press the upper belt 64 toward the cylinder tube 12.

More specifically, as will be described, when the slide table 14 moves, the belt separators 62*a*, 62*b* act to separate (open) the upper and lower belts 64 and 66 from one another, while the presser members 74*a*, 74*b* act to bring together (close) the upper belt 64 and lower belt 66.

On both ends of the slide table 14, there are scrapers 76*a*, 76*b* in contact with the upper belt 64, and the scrapers 76*a*, 76*b* prevent dust from coming into the space between the slide table 14 and the upper belt 64.

The end plates 16*a* and 16*b* are attached to both ends of the cylinder tube 12 so as to block the openings of the bore 20. In this case, the end plates 16*a*, 16*b* are attached to the cylinder tube 12 by mounting screw members 80*a* to 80*c* as shown in FIG. 1 to the screw holes 36*a* to 36*c* as shown in FIG. 2.

As shown in FIG. 4, the space between the end plates 16*a*, 16*b* and the bore 20 is blocked in an airtight manner by a gasket 82 formed of a rubber material or the like. (In FIG. 4, only the side of the end plate 16*a* is shown.) As a result, chambers 84*a*, 84*b* are formed between the end plate 16*a* (gasket 82) and the piston 50 (pressure receiving surface 56*a*), and between the end plate 16*b* (the gasket which is not shown) and the piston 50 (pressure receiving surface 56*b*), respectively in the bore 20.

In the part of the gasket 82 facing the bore 20, a projection 86 is provided. In this case, this projection 86 may be abutted against the end of the piston 50 (pressure receiving surfaces 56*a*, 56*b*). More specifically, the projection 86 can buffer the impact given when the piston 50 reciprocates to reach the ends of the bore 20 and comes into contact with the end plates 16*a*, 16*b*.

Figure 7:
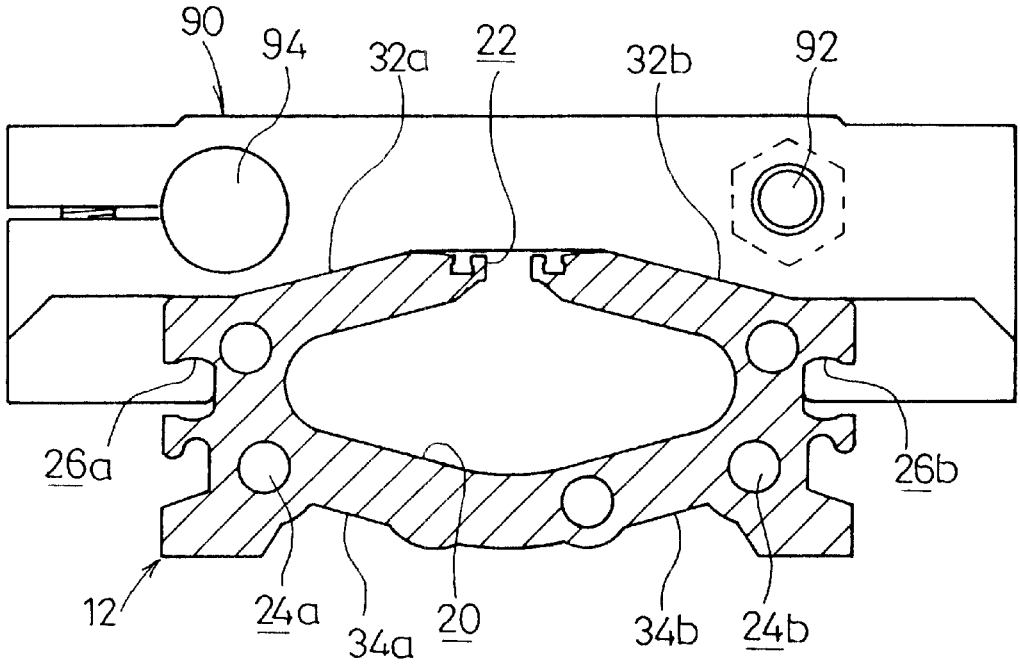
FIG. 7 is a vertical sectional view of the state in which a stopper member is attached to the cylinder tube in FIG. 2.

Also as shown in FIG. 7, the cylinder tube 12 is attached with a stopper member 90, and an adjuster bolt 92 provided at the stopper member 90 is used to restrict the moving range of the slide table 14. Meanwhile, a shock absorber 94 provided at the stopper member 90 may buffer impact given when the slide table 14 is in contact with the adjuster bolt 92.

In this case, the adjuster bolt 92 and the shock absorber 94 are provided along the thinned portions 32*a*, 32*b*, respectively.

Note that the stopper member 90 is attached at the elongate grooves 26*a*, 26*b* for attaching a sensor formed in the cylinder tube 12.

As shown in FIG. 1, ports 100*a*, 100*b* are formed at the end plates 16*a*, 16*b*, respectively. These ports 100*a*, 100*b* are connected for example with a compressed air supply source through a selector valve which is not shown.

As shown in FIG. 4, the ports 100*a*, 100*b* are in communication with the chambers 84*a*, 84*b* in the cylinder tube 12 through passages (not shown) in the end plates 16*a*, 16*b*, respectively. Note that other ports formed in the end plates 16*a*, 16*b* (ports 102, 104 as shown in FIG. 1 for example) are blocked by a sealing screw 106.

The operation of the rodless cylinder 10 having the above-described structure will be now described.

As shown in FIGS. 1 and 4, one port 100*a* is supplied with compressed air, which is then introduced into the chamber 84*a* in the cylinder tube 12 through a passage which is not shown. As the compressed air presses the piston 50 to the right in FIG. 4, the slide table 14 moves to the right with the piston 50.

At this time, the upper and lower belts 64 and 66 at the right of the slide table 14 in FIG. 14 which have been brought together by the presser member 74*b* are separated by the belt separator 62*b* as the slide table 14 moves.

The upper and lower belts 64 and 66 in the vicinity of the center of the slide table 14 which have been separated by the belt separators 62*a*, 62*b* are brought together by the presser member 74*a* as the slide table 14 moves.

More specifically, the slide table 14 is moved along the cylinder tube 12 while sealing the slit 22 using the upper belt 64 and lower belt 66, thereby keeping the bore 20 in an airtight manner.

When the port to supply the compressed air is switched between the ports 100*a* and 100*b*, i.e., when the compressed air is supplied from the other port 100*b*, the compressed air is introduced into the chamber 84*b* in the cylinder tube 12 through a passage which is not shown. As the compressed air presses the piston 50 to the left in FIG. 4, the slide table 14 moves to the left with the piston 50.

At this time, as opposed to the case in which the slide table 14 moves to the right, the upper belt 64 and lower belt 66 which have been brought together by the presser member 74*a* are separated by the belt separator 62*a*. Meanwhile, the upper and lower belts 64 and 66 which have been separated by the belt separators 62*a*, 62*b* are brought together by the presser member 74*b*.

As described above, in the rodless cylinder 10 according to the present embodiment, the bore 20 in the cylinder tube 12 is formed to have an approximately rhombic cross section. Thus, the rigidity of the cylinder tube 12 is not lowered as compared to the conventional case of forming the bore to have an approximately oval or ellipse cross section.

Furthermore, the approximately rhombic cross section of the bore 20 has a thickness T smaller than a width W. Therefore, the high rigidity of the cylinder tube 12 is maintained while the thickness of the rodless cylinder 10 may be reduced.

In this case, since the bore 20 is formed to have an approximately rhombic cross section, a space to attach an air cushion seal (not shown) for example may be secured in the center of the bore 20.

In addition, the fluid bypass passages 24*a*, 24*b* for centralized piping are formed on both sides of the bore 20 in the vicinity of the bottom. Therefore, a space to form the fluid bypass passages 24*a*, 24*b* can be secured while the thickness of the cylinder tube 12 is reduced.

Furthermore, the bore 20 is formed to have an approximately rhombic cross section and therefore the thinned portions 32*a*, 32*b* and 34*a*, 34*b* can be formed in the vicinity of both sides of the bore 20 at the lower and upper surfaces of the cylinder tube 12. Thus, the weight of the cylinder tube 12 can be reduced.

In this case, since the adjuster bolt 92 and the shock absorber 94 are provided along the thinned portions 32*a*, 32*b*, the thickness of the rodless cylinder 10 can be reduced while the space to provide the adjuster bolt 92 and the shock absorber 94 may be secured.

In addition, each corner portion 20*a* to 20*c* of the approximately rhombic cross section of the bore 20 are formed into an approximately circular shape, so that a belt (lower belt in particular) for a slit seal used in the rodless cylinder having a bore with a circular cross section for example can be applied to the rodless cylinder 10 according to the present embodiment.

What is claimed is:

1. A rodless cylinder, comprising:

a cylinder tube having a bore;

a piston provided in said bore;

a slide table coupled to said piston to reciprocate along said cylinder tube with movement of said piston, wherein said bore is formed to have an approximately rhombic cross section in which a thickness of said bore is smaller than a width of said bore, and wherein a fluid bypass passage for centralized piping is formed in a vicinity of a side portion of said bore in said cylinder tube, and a thinned portion having a thickness reduced relative to a rectangular plane circumscribing the cylinder tube is formed in the vicinity of said side portion of said bore at an outer surface of said cylinder tube.

2. The rodless cylinder according to claim 1, wherein respective corner portions of said approximately rhombic cross section of said bore are approximately circular in shape.

3. The rodless cylinder according to claim 1, wherein said rodless cylinder comprises an adjuster bolt which restricts a moving range of said slide table, wherein said adjuster bolt is disposed along said thinned portion.

4. The rodless cylinder according to claim 3, wherein said rodless cylinder comprises a shock absorber which buffers an impact given when said slide table contacts said adjuster bolt, wherein said shock absorber is disposed along said thinned portion.

5. The rodless cylinder according to claim 4, further comprising a stopper member attaching said adjuster bolt and said shock absorber to said cylinder tube, wherein an elongate groove extending parallel to said bore is formed along an outer surface of said cylinder tube, for attachment of said stopper member and for attachment of a sensor for detecting a position of said piston.

6. The rodless cylinder according to claim 4, further comprising a stopper member attaching said adjuster bolt and said shock absorber to said cylinder tube, wherein an elongate groove extending parallel to said bore is formed along an outer surface of said cylinder tube, for attachment of either said stopper member or a sensor for detecting a position of said piston.

7. A rodless cylinder, comprising:

a cylinder tube having a bore;

a piston provided in said bore;

a slide table coupled to said piston to reciprocate along said cylinder tube with movement of said piston, wherein said bore is formed to have an approximately rhombic cross section, and a thinned portion having a thickness reduced relative to a rectangular plane circumscribing the cylinder tube is formed in a vicinity of a side portion of said bore at an outer surface of said cylinder tube;

an adjuster bolt which restricts a moving range of said slide table disposed along said thinned portion;

a shock absorber which buffers an impact given when said slide table contacts said adjuster bolt disposed along said thinned portion; and a stopper member attaching said adjuster bolt and said. shock absorber to said cylinder tube, wherein an elongate groove extending parallel to said bore is formed along an outer surface of said cylinder tube, for attachment of said stopper member and for attachment of a sensor for detecting a position of said piston.

8. The rodless cylinder according to claim 7, wherein respective corner portions of said approximately rhombic cross section of said bore are approximately circular in shape.

9. The rodless cylinder according to claim 7, wherein a fluid bypass passage for centralized piping is formed in a vicinity of a side portion of said bore in said cylinder tube.

* * * * *